US006202254B1

(12) United States Patent
Ezer

(10) Patent No.: US 6,202,254 B1
(45) Date of Patent: Mar. 20, 2001

(54) TELESCOPING HANDLE

(76) Inventor: Shaul Ezer, 45 Greyhound Drive, North York, Ontario (CA), M2H 1K2

( * ) Notice: Subject to any disclaimer, the term of this patent is extended or adjusted under 35 U.S.C. 154(b) by 0 days.

(21) Appl. No.: 09/264,008

(22) Filed: Mar. 8, 1999

Related U.S. Application Data

(60) Provisional application No. 60/083,777, filed on Mar. 10, 1998, and provisional application No. 60/085,272, filed on May 13, 1998.

(51) Int. Cl.[7] ..... B25G 1/04; B62B 1/12

(52) U.S. Cl. ..... 16/113.1; 280/655; 280/47.26; 280/47.315

(58) Field of Search ..... 16/113.1, 405, 16/429; 280/37, 655, 655.1, 47.26, 47.315; 403/109.1, 109.2, 109.3, 109.5, 109.8, 377, 329; 190/15 R, 22, 104; 135/139, 140, 141, 142, 75

(56) References Cited

U.S. PATENT DOCUMENTS

| | | | | |
|---|---|---|---|---|
| 1,495,752 | * | 5/1924 | La Rue | 16/405 |
| 1,839,309 | * | 1/1932 | Gundel | 135/75 X |
| 1,953,387 | * | 4/1934 | Benjamin | 135/75 |
| 2,641,012 | | 6/1953 | Storrs | 15/144.4 |
| 2,980,456 | | 4/1961 | McMullin | 403/328 |
| 3,153,252 | | 10/1964 | Ricciardi | 15/144.4 |
| 3,513,952 | | 5/1970 | Warner, Jr. | 16/113.1 |
| 3,998,476 | | 12/1976 | Kazmark, Sr. | 280/655 |
| 4,325,157 | | 4/1982 | Balint et al. | 15/144.4 |
| 4,411,343 | | 10/1983 | Cassimally et al. | 190/18 A |
| 4,618,035 | | 10/1986 | Mao | 190/18 A |
| 4,896,687 | * | 1/1990 | Segal et al. | 135/75 |
| 5,025,820 | * | 6/1991 | Gamper | 135/75 X |
| 5,127,664 | | 7/1992 | Cheng | 280/655 |
| 5,460,393 | * | 10/1995 | Tsai | 280/655 |
| 5,469,602 | * | 11/1995 | Lin | 16/113.1 |
| 5,533,601 | * | 7/1996 | Wang | 16/113.1 X |
| 5,542,150 | * | 8/1996 | Tu | 16/113.1 |
| 5,926,915 | * | 7/1999 | Chou | 16/113.1 |

* cited by examiner

*Primary Examiner*—Anthony Knight
*Assistant Examiner*—Robert L. Pilaud
(74) *Attorney, Agent, or Firm*—Dimock Stratton Clarizio; Mark B. Eisen

(57) ABSTRACT

A telescoping member comprising an inner tubular member nested in an outer tubular member and movable between a retracted position and an extended position in telescoping relation, in which the inner tubular member is releasably lockable to the outer tubular member in the extended position by a resilient ledge cooperating with a fixed ledge, the resilient ledge being disposed within a longitudinal channel defined between an inner surface of the outer tubular member and an outer surface of the inner tubular member. An enlarged lower portion of the inner tubular member engages against an inwardly directed lip at the top of the outer tubular member such that the inner tubular member is prevented from being pulled out of the outer tubular member. Upon the application of axial force to the inner tubular member the resilient ledge is depressed, allowing the resilient ledge to travel past the fixed ledge so that the inner tubular member can move to the retracted position. A plurality of tubular members can be used to form a handle for a luggage item.

21 Claims, 6 Drawing Sheets

FIG.1. PRIOR ART.
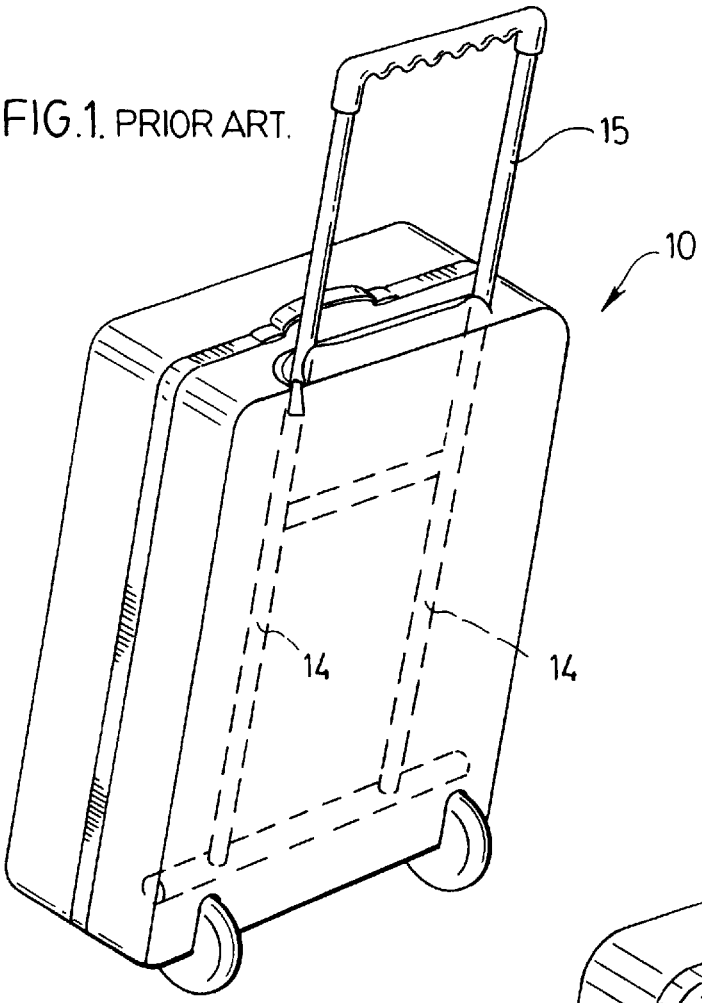
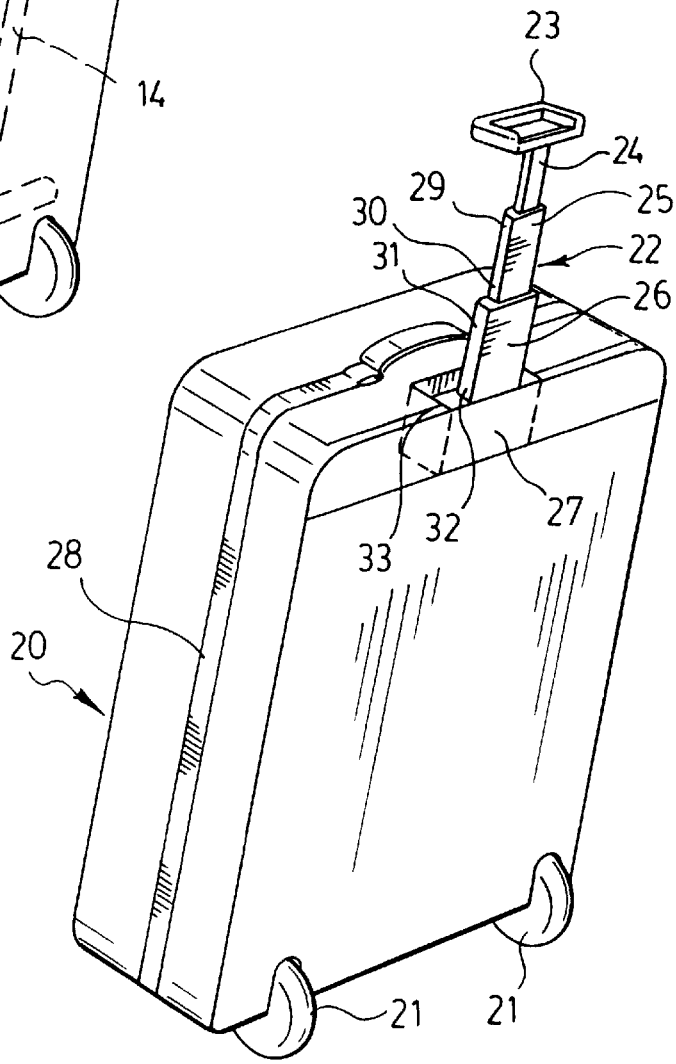
FIG.2.

TELESCOPING HANDLE

This application claims priority from U.S. provisional patent application Nos. 60/083,777, filed on Mar. 10, 1998, and 60/085,272 filed on May 13, 1998.

FIELD OF THE INVENTION

The present invention relates to a telescoping handle which attaches to a luggage item or a luggage carrier.

BACKGROUND TO THE INVENTION

In recent years, handles having retractable shafts became increasingly popular, particularly for pulling luggage items mounted on wheels. The retractable shafts are attached to a handle grip and can be elongated to an extended position for the purpose of pulling the luggage item, e.g. a suitcase. This arrangement provides a convenient way for wheeling the luggage item.

When not in use, the shafts are retracted into tubes built into the luggage item. The tubes built into the luggage item introduce two negative aspects. First, they take up valuable storage space in the luggage item. Second, they provide a bumpy surface for packing goods inside the luggage item. It is preferable, therefore, to have a handle that uses minimum space when retracted into the luggage item.

It is common in telescoping handles to have means for securing the telescoping members in the extended position. Typically, such securing means comprise the insertion of a ball or a pin through coincident apertures in the telescoping members. Typically, the ball or pin is sprung as disclosed in U.S. Pat. No. 5,127,664 to Chiun-Jer Cheng, which was issued Jul. 7, 1992.

The sprung balls or pins introduce two disadvantages. First, they add to the cost of production. Second, they prevent the telescoping members from being completely retracted. Typically, the sprung balls occupy about 4 cm in the longitudinal direction of each overlap of two telescoping members. Thus, multi-member telescoping handles which use sprung balls are very long in the retracted position. For example, a three member telescoping handle which uses sprung balls retracts to a size about 8 cm longer than a fully retracted handle. Similarly, a four member telescoping handle which uses sprung balls retracts to a size about 12 cm longer than a fully retracted handle.

The present invention is directed to alleviating some of the aforementioned difficulties or problems and provide a collapsible handle which takes up little space.

SUMMARY OF THE INVENTION

The invention thus provides a telescoping member comprising an outer tubular member having a lower portion and an upper portion having an open top end, an inner tubular member having a lower portion disposed through the open end of the outer tubular member and an upper portion, the inner tubular member being slidably disposed within the outer tubular member and movable between a retracted position and an extended position in telescoping relation, the inner tubular member being releasably lockable to the outer tubular member in the extended position by a locking mechanism comprising the upper portion of the outer tubular member providing a first ledge, and the lower portion of the inner tubular member providing a second ledge, at least one of the first ledge and the second ledge being a resilient ledge having a rest condition and a depressed condition, whereby in the extended position the first ledge projects into a space defined by the outer tubular member and abuts against the second ledge to releasably lock the inner tubular member in the extended position, and upon the application of axial force to the inner tubular member the resilient ledge is forced to the depressed condition allowing the first ledge to travel past the second ledge so that the inner tubular member can move to the retracted position.

The invention further provides a telescoping member comprising an outer tubular member having a lower portion and an upper portion having an open top end with an inwardly directed lip, an inner tubular member disposed through the open top end of the outer tubular member, the inner tubular member being slidably disposed within the outer tubular member and movable between a retracted position and an extended position in telescoping relation, the inner tubular member having an upper portion and an enlarged lower portion for engaging against the lip when in the extended position, whereby in the extended position the inner tubular member is prevented from extraction from the outer tubular member by the engagement between the enlargement and the lip.

In one embodiment, the telescoping handle has a plurality of elongated tubular telescoping members in which adjacent elongated members are inner and outer members as defined above.

In a further embodiment a handle grip is attached at one end of the innermost telescoping member of a plurality of telescoping members.

BRIEF DESCRIPTION OF THE DRAWINGS

FIG. 1 is a view of a wheeled luggage item with a handle using the prior art.

FIG. 2 is a view of a wheeled luggage item with a telescoping handle of the present invention attached to the upper portion of the luggage item.

DETAILED DESCRIPTION OF PREFERRED EMBODIMENTS

Figure 3:
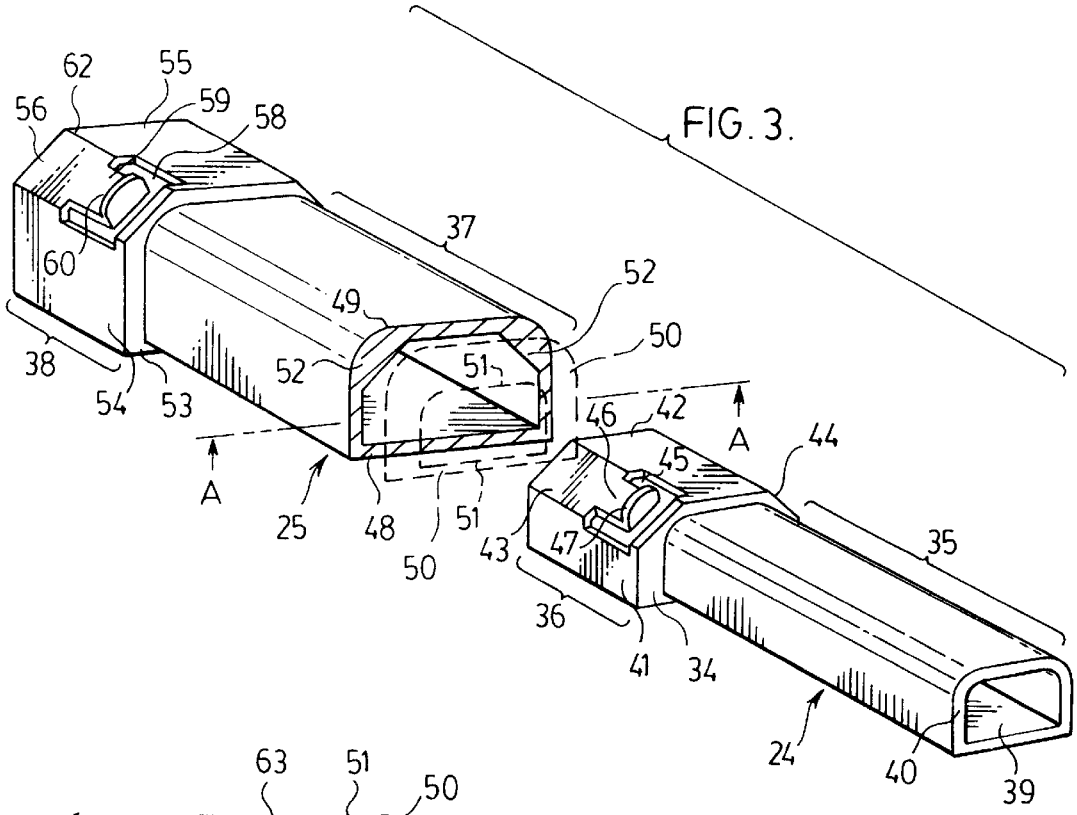
FIG. 3 is a view of two tubular members of the handle using the present invention. The larger tubular member is cut through two fixed ledges which protrude from the outer tubular member, with an outline of the remaining part of the outer member being shown by dotted lines.

FIG. 1 illustrates a suitcase 10 with a telescoping handle 15 of the prior art. The back of the suitcase is cut away to show two tubes 14 which are used to stow away the shafts of the handle. Typically, the two tubes are about 2.5 cm in diameter and span the whole length of the luggage item. For example, when the suitcase is about 70 cm high, the two tubes occupy approximately 0.35 $dm^3$ (liters) of storage space, as well as provide a bumpy surface for packing.

One embodiment of the telescoping handle of the present invention is shown in FIG. 2. The handle is extendable from a fully retracted position to a fully extended position.

FIG. 2 shows a luggage item 20 which has wheels 21 attached along one edge. Telescoping handle 22 comprises of handle grip 23 which is attached to first tubular member 24. First tubular member 24 is slidingly telescoped within second tubular member 25. Second tubular member 25 is slidingly telescoped within third tubular member 26. Tubular member 26 is slidingly telescoped within housing 27. Housing 27 is attached to the upper portion of luggage frame 28.

First and second tubular members 24 and 25 have locking means 29 and 30 which are not visible from the outside, and which will be described in more detail hereinafter, especially in relation to FIGS. 3, 4, and 5. Second and third tubular members 25 and 26 have locking means 31 and 32, which are not visible from the outside. Third tubular member 26 and housing 27 have locking means 33.

Although FIG. 2 is shown with a single shaft handle, it will be appreciated that a dual shaft handle, with two parallel tubular members, may be utilized, preferably with a common horizontal handle grip joining the two members.

A single shaft handle may be stowed in a housing with approximate dimensions which occupies 0.15 $dm^3$ (liters) of the top portion of the luggage item. The remaining portions of the luggage item are unobstructed by the handle. It will be understood that the size of the housing indicated herein is for illustration purposes only.

FIG. 3 shows first tubular member 24 which may be slidingly telescoped into second tubular member 25 in a manner which will be described hereinafter. Second tubular member 25 may be slidingly telescoped into third tubular member 26 (not shown) in the same manner as the first and second tubular members.

First tubular member 24 has an upper portion 35 and a lower portion 36. In the embodiment shown, the transverse cross-section of upper portion 35 is D-shaped, with a flat wall 39 and U-shaped wall 40. The lower portion 36 is attached to upper portion 35 at step 34. Lower portion 36 has a substantially irregularly hexagonal transverse cross-section.

Second tubular member 25 is similarly shaped to first tubular member 24 and has an upper portion 37 and a lower portion 38 joined at step 53. The transverse cross-section of upper portion 37 is D-shaped, with a flat wall 48 and U-shaped wall 49.

Figure 5:
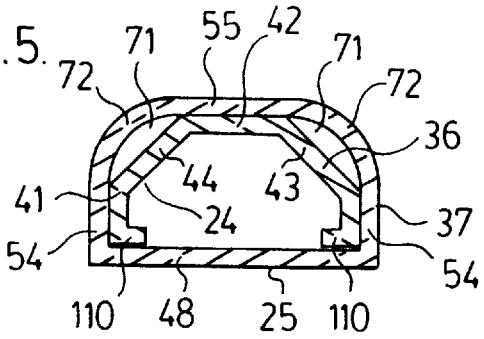
FIG. 5 is a transverse sectional view of nesting portions of adjacent inner and outer tubular members.

In FIG. 5, lower portion 36 of first tubular member 24 has walls 110. The outer surfaces of walls 110 generally conform to the shape of the inner surfaces of the walls 48 of the second tubular member 25. Walls 110 are joined to walls 41. The outer surfaces of walls 41 generally conform to the shape of the inner surfaces of walls 54 of second tubular member 25. Walls 41 are joined to wall 42, the outer surface of which generally conforms to the inner surface of wall 55, by corner walls 43 and 44. There are channels 71 between rounded portion 72 and corner walls 43 and 44, the purpose of which will be explained hereinafter. As will be explained hereinafter, in the extended position, lower portion 36 of first tubular member 24 is nested within upper portion 37 of second tubular member 25 and is in sliding contact therewith along sliding surfaces between walls 48/110, 54/41 and 55/42.

In FIG. 3, in addition to the shaping of lower portion 36 of first tubular member 24, the lower portion has an externally facing ledge 47. A spring for ledge 47 is formed by a tongue 46 in wall 43, by an aperture 45 in wall 43 which surrounds three sides of tongue 46. A similar ledge and tongue is in wall 44 but cannot be seen in FIG. 3. Second tubular member 25 also has an externally facing ledge 60, tongue 59 and aperture 58 in wall 56, in a similar configuration to those items in first tubular member 24. Tongues 46 and 59 allow ledges 47 and 60 respectively to be depressed inwardly towards the longitudinal axes of tubular members 24 and 25 respectively. The externally facing ledges 47 and 60 sometimes may be referred herein as resilient ledges.

The tubular members each have a set of upper, internally facing ledges and a set of lower, internally facing ledges, as will be described in reference to FIGS. 3 and 4. Upper ledges 52 are spaced a short distance away from the end of upper portion 37 which is distal from lower portion 38. Ledges 52 face internally and project into longitudinal channels 71 shown in FIG. 5. Lower ledges 61 preferably are at step 53, at the end of upper portion 37 which is adjacent to lower portion 38. Lower ledges 61 also project internally into longitudinal channels 71. The internally facing ledges 52 and 61 sometimes may be referred herein as fixed ledges.

Figure 4:
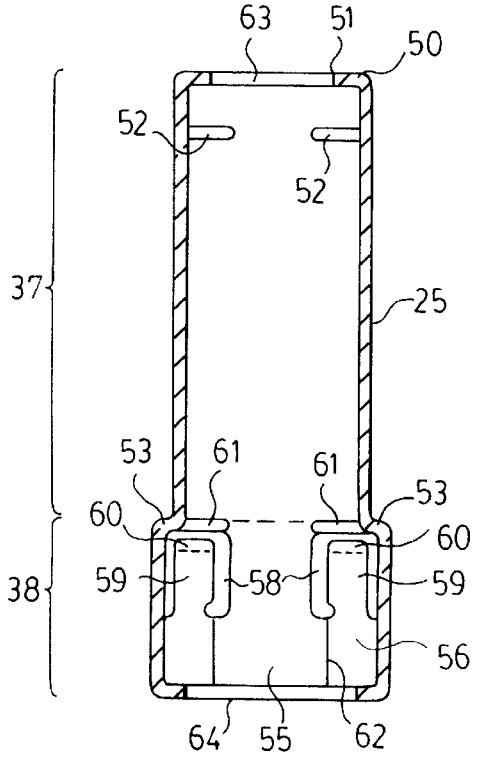
FIG. 4 is a sectional view of one tubular member, along lines A—A of a Figure

In FIG. 4, the tongues 59 are also seen. They are surrounded on three sides by apertures 58, and have externally facing ledges 60 attached thereto. Line 62 are the corner joint between walls 55 and 56. The end of upper portion 37, distal from lower portion 38, has an internally directed lip 50 in which there is an aperture 63, delineated by edge 51. The shape of lip 50 preferably conforms to the shape of upper portion 35 of first tubular member 24, so that upper portion 35 may slide along and be guided by edge 51. In addition, edge 51 provides a means for preventing removal of first tubular member 24 from second tubular member 25. The lip 50, at edge 51, is fixed and inflexible so that the lip 50 engages with step 34, thus preventing passage of lower portion 36 past lip 50. 1he end of lower portion 38, distal to upper portion 37, is open and preferably has an aperture 64 which conforms to the external shape of lower portion 36 so that tubular member 24 can retract fully into tubular member 25.

FIGS. 6*a*, 6*b*, 6*c* and 6*d* show sectional views of further examples of nesting shapes for upper portions of a second tubular member and lower portions of a first tubular member.

Figure 6A:
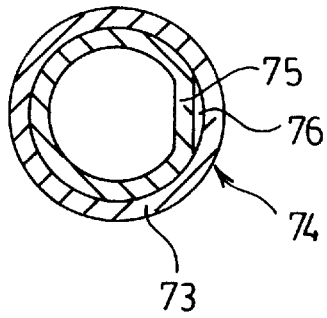
FIGS. 6*a* through 6*d* are transverse sectional views of alternatively shaped tubular members to that shown in FIG. 5.

FIG. 6*a* shows an upper portion 74 of a second tubular member, which has a circular cross-section. Inside upper portion 74 is lower portion 73 of a first tubular member, the outer surface of which, for the most part, conforms to the inner surface of upper portion 74. There is, however, a flattened segment 75 to lower portion 73 such that there is a longitudinal channel 76 between upper portion 74 and lower portion 73.

Figure 6B:
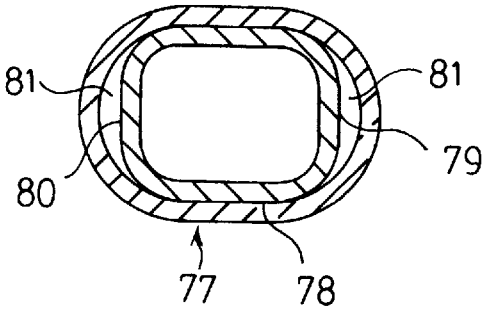

FIG. 6*b* is a second alternative structure for the tubular members. It shows an upper portion 77 of a second tubular member, which has a substantially elliptical cross-section. Inside upper portion 77 is lower portion 78 of a first tubular member, the outer surface of which, for the most part, conforms to the inner surface of upper portion 77. There are, however, flattened segments 79 and 80 to lower portion 78 such that there are longitudinal channels 81 between upper portion 77 and lower portion 78.

Figure 6C:
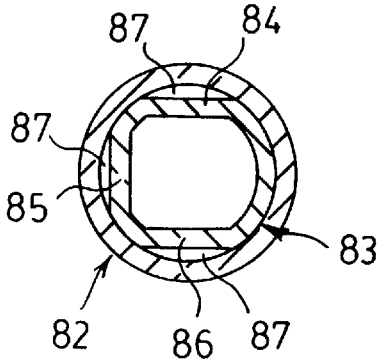

FIG. 6*c* shows an upper portion 82 of a second tubular member, which has a circular cross-section. Inside upper portion 82 is lower portion 83 of a first tubular member, the outer surface of which, for the most part, conforms to the inner surface of upper portion 82. There are, however, three flattened segments 84, 85 and 86 to lower portion 83 such that there are three longitudinal channels 87 between upper portion 82 and lower portion 83.

Figure 6D:
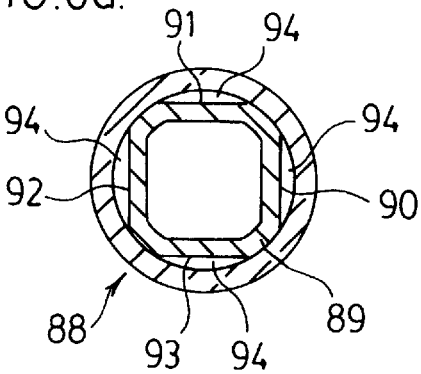

FIG. 6*d* shows an upper portion 88 of a second tubular member, which has a circular cross-section. Inside upper portion 88 is lower portion 89 of a first tubular member, parts of the outer surface of which conform to the inner surface of upper portion 88. There are four flattened segments 90, 91, 92 and 93 to lower portion 89 such that there are four longitudinal channels 94 between upper portion 88 and lower portion 89.

Although various shapes for the inner and outer elongated members have been shown in FIGS. 6*a* to 6*d*, it will be understood that these illustrations are not limiting and that various shapes may be used, provided that at least one sufficiently large longitudinal channel is present between adjacent tubular members.

It will be understood that it may be desirable to add strengthening ribs to the elongated tubular members. For example, strengthening ribs may be provided longitudinally inside the tubular members.

Figure 7:
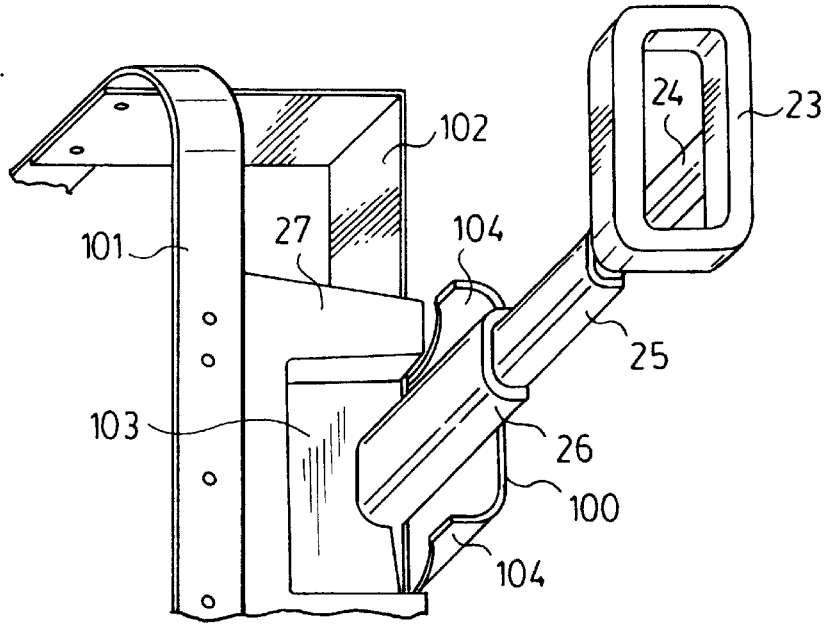
FIG. 7 is a view of the attachment of the handle of the present invention to the frame (partially shown) of a luggage item.

FIG. 7 shows a way of attaching the telescoping handle to an upper portion of the frame of a luggage item. As far as Applicant is aware, this configuration is unlike known handles for luggage items in that the present handle is not anchored to the bottom of the luggage item. In the embodiment shown, housing 27 is secured to frames 101 and 102 of the luggage item. Handle grip 23 preferably is shaped to nest into an inset cavity 103 of housing 27, so that the handle grip 23 is stowed away. It will be understood that handle grip 23 may be of any convenient shape, e.g. a bar or a D-shape. A D-shaped handle grip may swivel about a hinge at the extremity of first tubular member 24.

FIG. 7 also shows a single shaft telescoping handle with first tubular member 24, second tubular member 25 and third tubular member 26. In the embodiment shown, the housing 27 has a lid 100. The lid 100 has wings 104. The lid 100 provide a means for securing the handle from being extended accidentally during transport. The lid 100 also has a second function of ensuring that no rain water gets inside the luggage when in transport. Wings 104 provide means of securing a tote bag on top of the luggage item. To applicant's knowledge, single shaft handles have no means for securing a tote bag.

Figure 8:
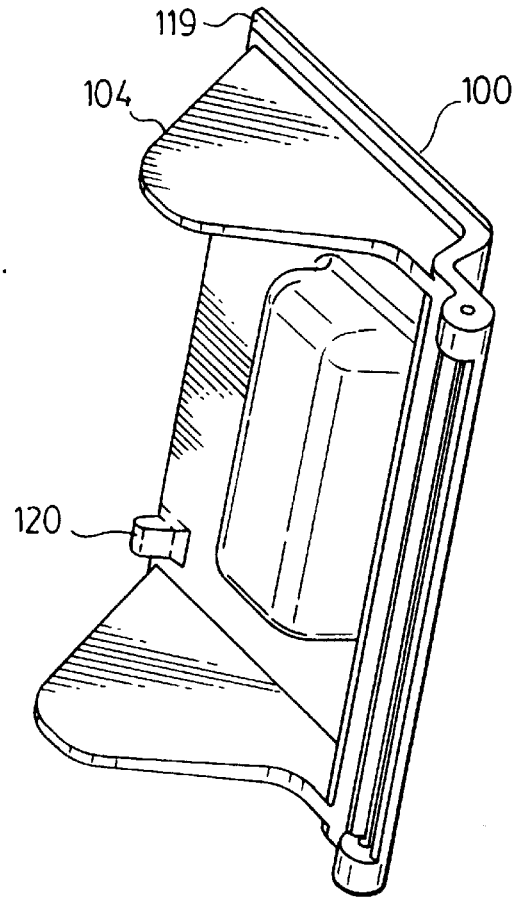
FIG. 8 is a perspective view of a lid, useful for covering the handle grip when retracted into a housing.
Figure 9:
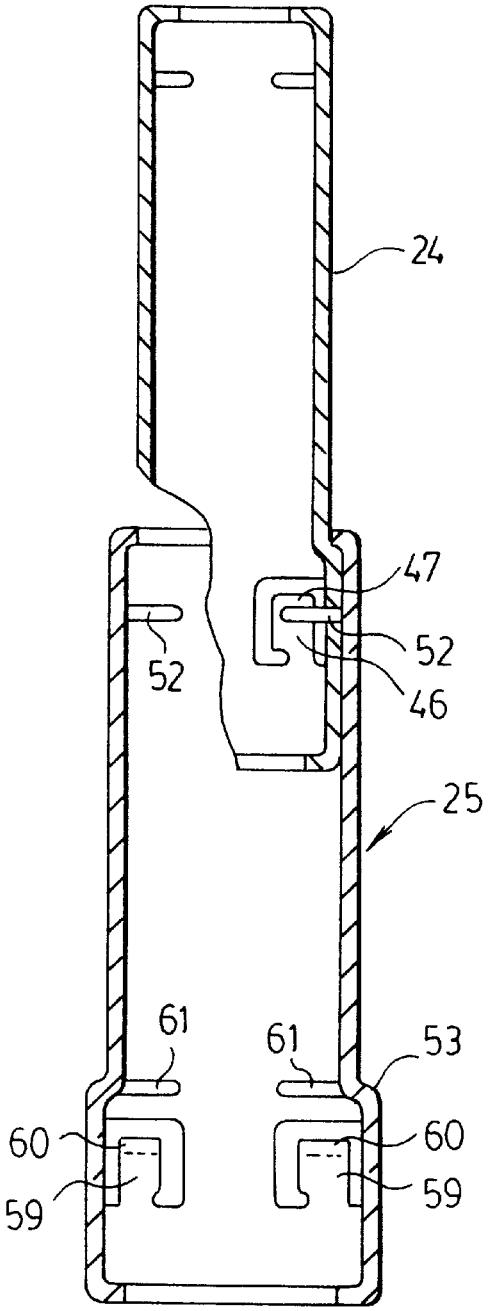
FIG. 9 is a sectional view showing the inner tubular member in a fully extended position.
Figure 10:
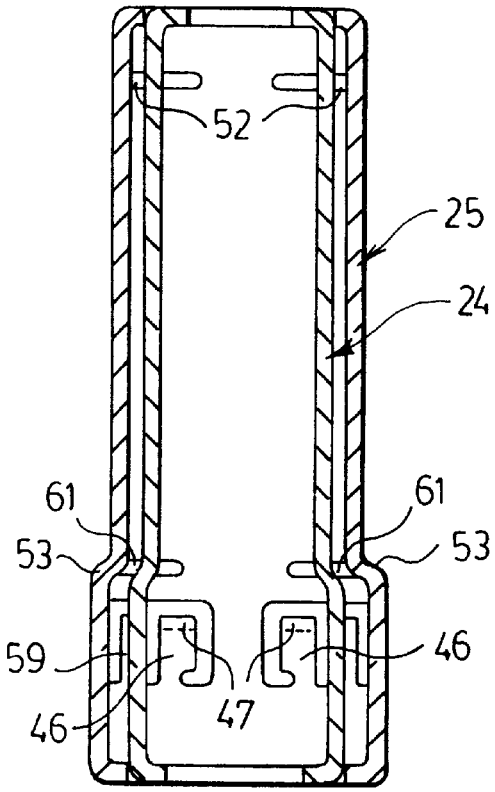
FIG. 10 is a sectional view showing the inner tubular member in a fully retracted position.

FIG. 8 is a view of the lid 100. The lid has slanted edges 119 which provide a sliding fit to seal the cavity 103 in the housing 27. The sliding fit is attained by having corresponding slanted edges (not shown) in the walls of the cavity 103. The lid has tongues 120 which lock into indentations (not shown) in the housing 27 to prevent the lid from being opened inadvertently. The lid has wings 104 which are used to stabilize a tote bag when placed on top of the luggage item.

It will be seen from FIG. 5 that frictional engagement between the tubular members is lowered by having sliding surfaces only along lips 110, and walls 41 and 42 of the lower portion 36 of first tubular member 24. Lowering of friction may also be accomplished, if desired, by coating the sliding surfaces with a non-stick coating. Coating is usually not necessary. Although lowering of friction is not a particularly important aspect of the invention, it makes operation of the handle easier for some people, e.g. seniors.

Locking means are provided for the tubular members in order to keep the handle in an extended position or in a compact position. Locking is brought about by cooperation of the fixed and resilient ledges. One part of the locking means is provided inside at least one channel between the upper portion of one tubular member and the lower portion of an adjacent tubular member, and the other part of the locking means is provided on the outer periphery of the lower portion of the appropriate tubular member.

With reference to FIGS. 3 and 4, upper locking means is provided by sprung (resilient) ledge 47 of first tubular member 24 and fixed ledge 52 of second tubular member 25. Lower portion 36 of first tubular member 24 is prevented from escaping from the confines of upper portion 37 of second tubular member 25 by lip 50 at the end of upper portion 37. Lower locking means is provided by sprung (resilient) ledge 47 of first tubular member 24 and fixed ledge 61 of second tubular member 25. Lower portion 36 of first tubular member 24 is prevented from escaping from the confines of lower portion 38 of second tubular member 25, through aperture 64, by a bottom of housing 27 (not shown). Lower portion 36 of first tubular member 24 is also prevented from escaping from the confines of lower portion 38 of second tubular member 25, through aperture 64, by handle grip 23, which will come to rest on lip 50 when in the handle is in the retracted position.

It will be understood that second and third tubular members and all other adjacent tubular members, if present, will extend and retract, and lock in the same manner as the first and second tubular members.

Resilient ledges 47 and fixed ledges (52 or 61) interfere with one another as first and second tubular members are extended or retracted. Resilient ledges 47 may be sprung as shown in FIGS. 3 and 4 or otherwise made sufficiently deformable that they may be forced past fixed ledges 52 or 61. Alternatively, ledges 52 and 61 may be made of resilient material so that such ledges may flex slightly to allow ledges 47 to be forced past ledges 52 and 61. Ledges 47, 52 and 61 may be ramped along contacting surfaces in order to either make passage past one another easier or more difficult.

It will be understood that lip 50 may be replaced by another fixed ledge, which is sufficiently rigid that it would be virtually impossible for resilient ledge 47 to pass.

The telescoping handle, when extended, is used to pull a load, e.g. a suitcase, along the ground. When the telescoping handle is not in use, it may be collapsed and retracted into housing 27.

To operate the telescoping handle, the elongated members of the telescoping handle are extended by pulling on handle grip 23 (see FIGS. 2 and 7), thereby sliding each inner tubular member within an adjacent outer telescoping. Sliding motion may be facilitated if the sliding surfaces are coated with a low friction material, e.g. polytetrafluoroethylene. One such polytetrafluoroethylene is available from E.I. du Pont de Nemours and Company under the trade mark TEFLON. Sliding is continued until, with reference to FIGS. 3 and 4, the resilient ledges, e.g. ledges 47, "snap" over upper fixed ledges, e.g. ledges 52, so that the resilient ledges are between fixed ledges 52 and lip 50, thus securing the tubular members in extended position.

The telescoping handle may be retracted by pushing down on handle grip 23, so that resilient ledges, e.g. ledges 47 first "snap" over upper fixed ledges, e.g. ledges 52 and then over lower fixed ledges, e.g. ledges 61, until the tubular members are fully retracted. It will be noted that the tubular members do not "wobble" within one another because of i) the tight fit attainable due to the limiting of the contact surfaces to walls 48/110, 54/41 and 55/42, and ii) the placement of ledges 47 and 52 in such positions that when they "snap" into the locked position they exert pressure to push step 34 against lip 50.

Figure 12:
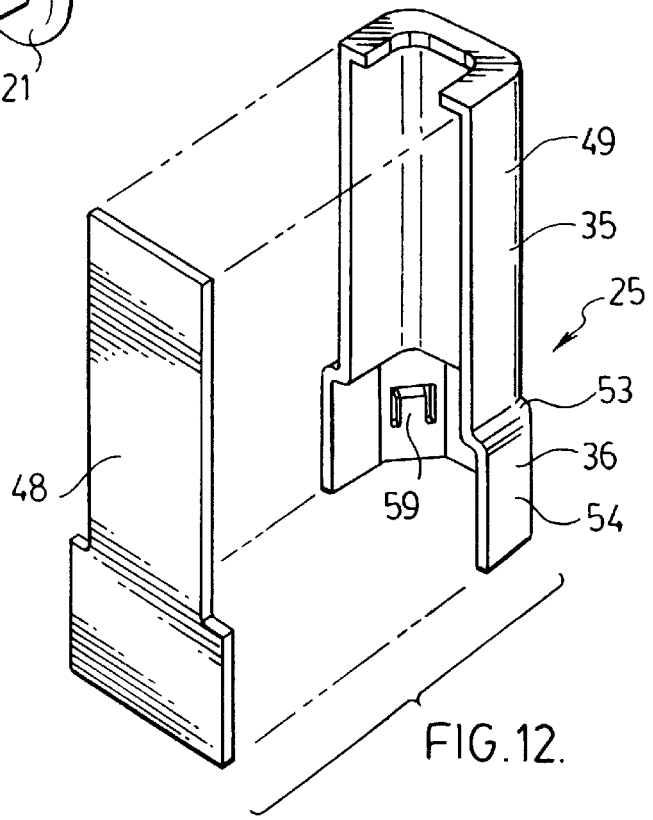
FIG. 12 is an exploded perspective view of a preferred embodiment of the tubular member

The outer and inner tubular members may be made of any suitable material, but for ease of manufacture, it is preferable that they are made of two longitudinal portions formed from synthetic thermoplastic or thermosetting polymer and bonded together, as shown in FIG. 12. This permits the elongated members to be molded using, for example, injection molding techniques. Preferred synthetic polymers are polycarbonate, acrylonitrile-butadiene-styrene (ABS) and mixtures thereof. Other polymers may be used, e.g. high density polyethylene, polypropylene, nylon.

Figure 11:
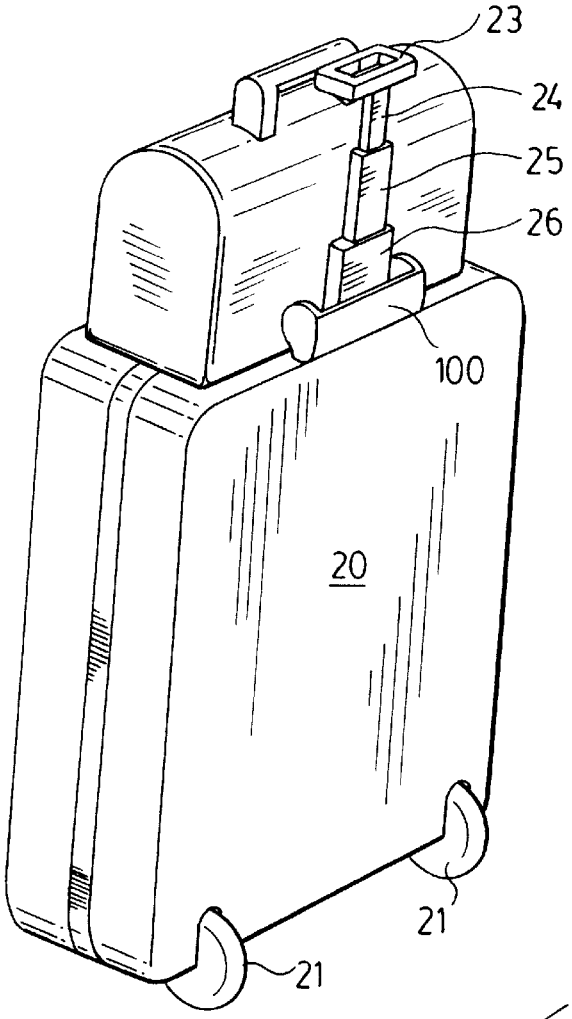
FIG. 11 is an elevational view showing the invention in use with a tote bag.

When the handle is in the extended position, a tote bag can be hung over the handle and rested on the top surface of the luggage item, as shown in FIG. 11. With a single shaft handle, as shown in FIG. 7. wings 104 serve to stabilize the tote bag and prevent it from swinging about the tubular members.

I claim:

1. A telescoping member comprising an outer tubular member having a lower portion and an upper portion having an open top end, an inner tubular member having a lower portion disposed through the open end of the outer tubular member and an upper portion, the inner tubular member being slidably disposed within the outer tubular member and movable between a retracted position and an extended position in telescoping relation, at least one longitudinal channel defined between an inner surface of the outer tubular member and an outer surface of the inner tubular member, the inner tubular member being releasably lockable to the outer tubular member in the extended position by a locking mechanism comprising the upper portion of the outer tubular member providing a first ledge, and the lower portion of the inner tubular member providing a second ledge, at least one of the first ledge and the second ledge being a resilient ledge having a rest condition and a depressed condition wherein in the rest position the resilient ledge is disposed within the longitudinal channel, whereby in the extended position the first ledge projects into a space defined by the outer tubular member and abuts against the second ledge to releasably lock the inner tubular member in the extended position, and upon the application of axial force to the inner tubular member the resilient ledge is forced to the depressed condition allowing the first ledge to travel past the second ledge so that the inner tubular member can move to the retracted position.

2. The telescoping member defined in claim 1 in which the other of the first ledge and the second ledge is fixed.

3. The telescoping member defined in claim 2 in which the second ledge is the resilient ledge.

4. The telescoping member defined in claim 3 in which the second ledge is disposed at an end of a resilient tongue affixed to the inner tubular member.

5. The telescoping member defined in claim 1 in which the outer tubular member is provided with a pair of first ledges and the inner tubular member is provided with a pair of second ledges.

6. The telescoping member defined in claim 1 in which the upper portion of the inner tubular member is affixed to a handle grip.

7. The telescoping member defined in claim 6 in which the outer tubular member is connected to a luggage item.

8. The telescoping member defined in claim 7 in which a handle is concealed beneath a lid hingedly connected to the luggage item and pivotable to an open position to expose the handle grip.

9. The telescoping member defined in claim 8 in which the lid is provided with wings which project on both sides of the telescoping member, wherein when the lid is in the open position the wings are adapted to provide support for a tote bag resting on top of the luggage item.

10. The telescoping member defined in claim 9 in which the lid is provided with at least one resilient tongue which engages a portion of the luggage item when the lid is in a closed position, to releasably lock the lid into the closed position.

11. The telescoping member defined in claim 10 in which the lid is provided with round edges.

12. The telescoping member defined in claim 7 in which the outer tubular member is anchored to the luggage item solely in a top portion of the luggage item.

13. The telescoping member defined in claim 1 comprising a plurality of tubular members nested within each other in telescoping relation.

14. The telescoping member defined in claim 13 in which each inner tubular member is provided with a locking mechanism comprising a second ledge projecting from a lower portion of the inner tubular member cooperating with a first ledge projecting from an outer tubular member in which each inner tubular member is respectively nested.

15. The telescoping member defined in claim 1 in which the outer tubular member comprises a ledge projecting from the lower portion of the outer tubular member for releasably locking the inner tubular member in the retracted position.

16. The telescoping member defined in claim 1 in which the outer tubular member is provided with an open bottom end to allow for sliding the inner tubular member into the outer tubular member.

17. The telescoping member defined in claim 1 in which at least one of the tubular members comprises two longitudinal portions formed from synthetic thermoplastic or thermosetting polymer and bonded together.

18. The telescoping member defined in claim 1 in which the outer tubular member comprises two longitudinal portions formed from synthetic thermoplastic or thermosetting polymer and bonded together.

19. A telescoping member comprising an outer tubular member having a lower portion and an upper portion having an open top end with an inwardly directed lip, an inner tubular member disposed through the open top end of the outer tubular member, the inner tubular member being slidably disposed within the outer tubular member and movable between a retracted position and an extended position in telescoping relation, the inner tubular member having an upper portion and an enlarged lower portion for engaging against the lip when in the extended position, the lower portion of the inner tubular member comprising a resilient ledge and the upper portion of the outer tubular member comprises a fixed ledge, whereby in the extended position the resilient ledge abuts against the fixed ledge to releasably lock the inner tubular member in the extended position, and upon the application of axial force to the inner tubular member the resilient ledge is forced to a depressed condition allowing the resilient ledge to travel past the fixed ledge so that the inner tubular member can move to the retracted position, and wherein in a rest position the resilient ledge is disposed within a longitudinal channel defined between the outer tubular member and the inner tubular member such that the resilient ledge travels through the longitudinal channel as the inner tubular member is moved between the extended and retracted positions, whereby in the extended position the inner tubular member is prevented from extraction from the outer tubular member by the engagement between the enlarged lower portion and the lip.

20. The telescoping member of claim 19 in which the lower portion of the inner tubular member comprises a step for engaging against the lip when in the extended position.

21. The telescoping member defined in claim 19 in which the outer tubular member is anchored to a luggage item solely in a top portion of the luggage item.

* * * * *